United States Patent [19]

Schawbel et al.

[11] Patent Number: 4,776,321

[45] **Date of Patent: * Oct. 11, 1988**

[54] HAIR ROLLER HEATING DEVICE

[75] Inventors: William Schawbel, Needham; Thaddeus Zaborowski, Pembroke, both of Mass.

[73] Assignee: The Schawbel Corporation, Cambridge, Mass.

[ * ] Notice: The portion of the term of this patent subsequent to Mar. 22, 2005 has been disclaimed.

[21] Appl. No.: 56,447

[22] Filed: Jun. 1, 1987

Related U.S. Application Data

[63] Continuation-in-part of Ser. No. 781,262, Sep. 27, 1985, Pat. No. 4,733,651.

[51] Int. Cl.[4] ..... A45D 2/36

[52] U.S. Cl. ..... 126/409; 132/226; 132/227

[58] Field of Search ..... 126/402–409, 126/236, 237; 132/33 R, 36 R; 34/90, 96

[56] References Cited

U.S. PATENT DOCUMENTS

| | | | |
|---|---|---|---|
| 3,181,789 | 5/1965 | Hill | 236/10 |
| 4,502,465 | 3/1985 | Yoshinaga et al. | 126/409 |
| 4,584,462 | 4/1986 | Morrison | 219/222 |

FOREIGN PATENT DOCUMENTS

| | | | |
|---|---|---|---|
| 212070 | 3/1924 | United Kingdom | 126/408 |
| 272201 | 9/1927 | United Kingdom | 126/408 |
| WO83/279 | 2/1983 | World Int. Prop. O. | 126/408 |

*Primary Examiner*—Samuel Scott
*Assistant Examiner*—Allen J. Flanigan
*Attorney, Agent, or Firm*—Peter L. Berger

[57] ABSTRACT

A portable hair roller heating device for heating flexible hair rollers, includes an enclosed heating chamber defined by a top wall, side wall and bottom wall, the top wall having a plurality of apertures through which the hair rollers to be heated can be inserted; a cover hingedly connected on the top wall so as to cover portions of the hair rollers extending through the top wall; first and second burners positioned adjacent the heating chamber, the first burner having a first burner tube with a free end and the second burner having a second burner tube with a free end; a single junction tube joining together the free ends of the first and second burner tubes, the junction tube having a free end extending into the chamber for heating the same; a fuel supply cartridge which supplies fuel to the burners and which controls the flow of fuel from the cartridge, the cartridge including a fuel supply valve; an ignitor assembly for igniting the fuel escaping from the free end of said junction tube; and a plunger which applies a force to the valve in response to user actuation, to start fuel flow.

29 Claims, 4 Drawing Sheets

HAIR ROLLER HEATING DEVICE

REFERENCE TO RELATED APPLICATION

This application is a continuation-in-part of U.S. patent application Ser. No. 06/781,262, filed Sept. 27, 1985, entitled PORTABLE CURLING IRON, to William Schawbel et al., now U.S. Pat. No. 4,733,651, the entire disclosure of which is incorporated herein by reference.

BACKGROUND OF THE INVENTION

This invention relates generally to portable heating appliances and, more particularly, is directed to a novel hair roller heating device.

Women often use hair rollers to set their hair with particular curls, waves and the like. It has been found that this is accomplished more easily if the hair rollers are flexible and heated. Accordingly, hair rollers have been developed comprised of a flexible plastic tube surrounding a flexible metal coil spring. In the unflexed state, the coil spring forces the plastic tube into a linear arrangement.

In addition, devices for heating these hair rollers have also been developed, whereby the metal coil spring is heated indirectly. For example, one such hair roller heating device is sold by Conair Corporation, 11 Executive Avenue, Edison, N.J. 08817 under the trademark "Hot Sticks". With this device, tight curls, soft curls and body waves can be achieved.

The Conair device includes a hollow housing having a plurality of spaced openings in the upper surface thereof through which the hair rollers can be inserted. Heating means is positioned within the housing and generally includes a plurality of metal tubes positioned with a vertical orientation in the housing below the openings. Thus, the hair rollers fit through the openings in the housing and are lodged in the metal tubes. The metal tubes, however, have separate heating blankets surrounding them, each heating blanket being electrically heated, thereby requiring an electric supply cord and a plug connected to the electric heating means. This is disadvantageous from a number of respects. First, if there is no electric outlet, heating can not be performed. Second, the use of an electric cord restricts placement of the device and may be dangerous if it becomes tangled or the like. Third, the construction is complicated due to the requirement of the electric heating blankets.

Curling irons which heat the barrel with a portable fuel source, such as a catalytic gas, are also well known. The catalytic converters thereof are powered by butane or similar type gases which may take the form of replaceable or refillable cartridges. Such portable curling irons are widely used, and may be conveniently used almost anywhere.

Catalytic burners for portable curling irons suffer from several disadvantages. First, they are slow to heat and expensive to manufacture, which are clearly undesirable. Additionally, if the temperature runs too high, the platinum catalyst sinters, reducing surface area, which reduces life.

Still further, catalytic converters can suffer from "hot spots" which can render them dangerous.

OBJECTS AND SUMMARY OF THE INVENTION

Accordingly, it is an object of this invention to provide a portable hair roller heating device.

It is another object of this invention to provide a portable hair roller heating device that does not require an electric current to operate.

It is still another object of this invention to provide a portable hair roller heating device which is readily adaptable to portable use, yet which permits rapid heating of the hair rollers therein.

It is a further object of this invention to provide a portable hair roller heating device in which the operating temperature is maintained substantially constant.

It is a still further object of this invention to provide a portable hair roller heating device in which a source of fuel is employed which may be rechargeable or refillable.

It is a yet further object of this invention to provide a portable hair roller heating device in which the element to be heated rapidly achieves the desired temperature, yet in which the temperature is maintained with decreased fuel consumption.

It is another object of this invention to provide a portable hair roller heating device which is safe to use.

In accordance with an aspect of the present invention, a portable heating appliance includes an enclosed heating chamber defined by a top wall, side wall and bottom wall, at least one of the walls having a plurality of apertures through which elongated objects to be heated can be inserted; burner means positioned adjacent the chamber for heating the objects inserted through the apertures, the burner means having a first burner tube with a free end and a heating tube fluidly connected with the first burner tube and extending into the chamber; fuel supply means for supplying fuel to the burner means through the first burner tube; and ignition means for igniting the fuel in the heating tube so as to heat the chamber.

The above and other objects, features and advantages of the present invention will become readily apparent from the following detailed description which is to be read in connection with the accompanying drawings.

DETAILED DESCRIPTION OF A PREFERRED EMBODIMENT

Figure 1:
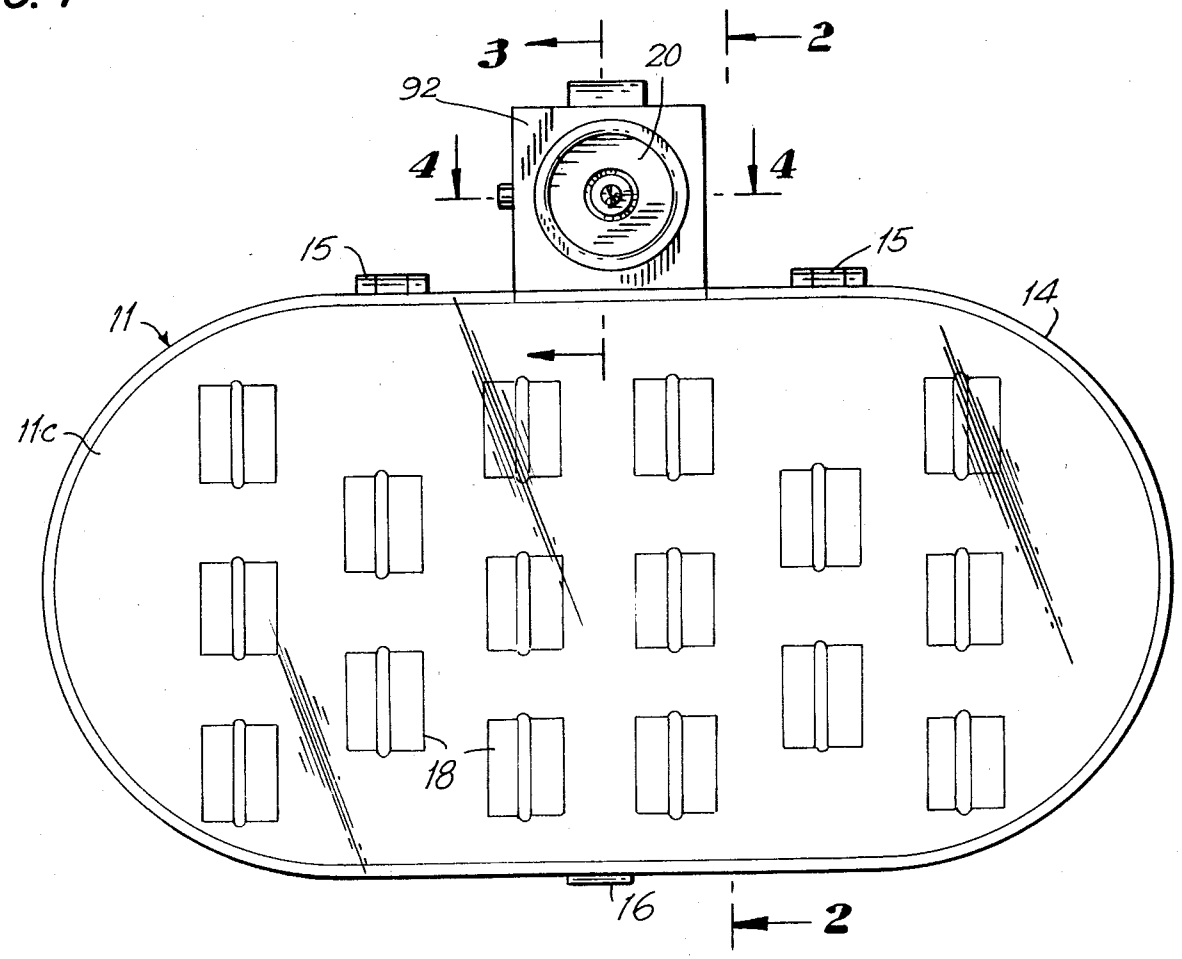
FIG. 1 is a top plan view of a portable hair roller heating device according to the present invention.

Referring to the drawings in detail, a portable hair roller heating device 10 according to the present invention includes a housing 11 having a generally oblong configuration, as shown in FIG. 1, although the present invention is not limited by this configuration. Housing 11 is preferably made of a sturdy plastic material, and is hollow, so as to form a heating chamber 12 defined by a bottom wall 11*a*, curved side wall 11*b* and top wall 11c of housing 11. A plurality of apertures 13 are provided in top wall 11c, the reason for which will become apparent from the description which follows.

A cover 14 is hingedly connected by hinges 15 to a rear part of top wall 11c, and includes a latch 16 on the opposite side thereof that matingly engages with a catch 17 on a front part of top wall 11c. The cover is cut out at the center thereof so that it is not restricted by the heating housing 92 at the rear of the device. However, the rear portion of side wall 11b is extended upwardly to be continuous with cover 14 when the latter is closed.

Thus, flexible hair rollers 18 of the aforementioned type can be inserted through apertures 13 into chamber 12 to be heated, when cover 14 is open. Then, cover 14 is closed, and hair rollers 18 are heated.

The arrangement thus far described is similar to the aforementioned hair roller heating device sold by Conair. With the present invention, however, there is are no electric heating means, metal tubes or electric heating blankets. Rather, the present invention uses a butane or other suitable gas to heat chamber 12, and thereby heat hair rollers 18.

Specifically, a switch button 19 (FIG. 4), as will be described in greater detail hereinafter, functions as an ON/OFF switch, to start the flow of a gas fuel, such as butane, from a fuel cartridge 20. Then, an ignitor push button 21 (FIG. 3) is depressed by the user to control a piezoelectric ignitor which ignites the butane to heat chamber 12.

Figure 4:
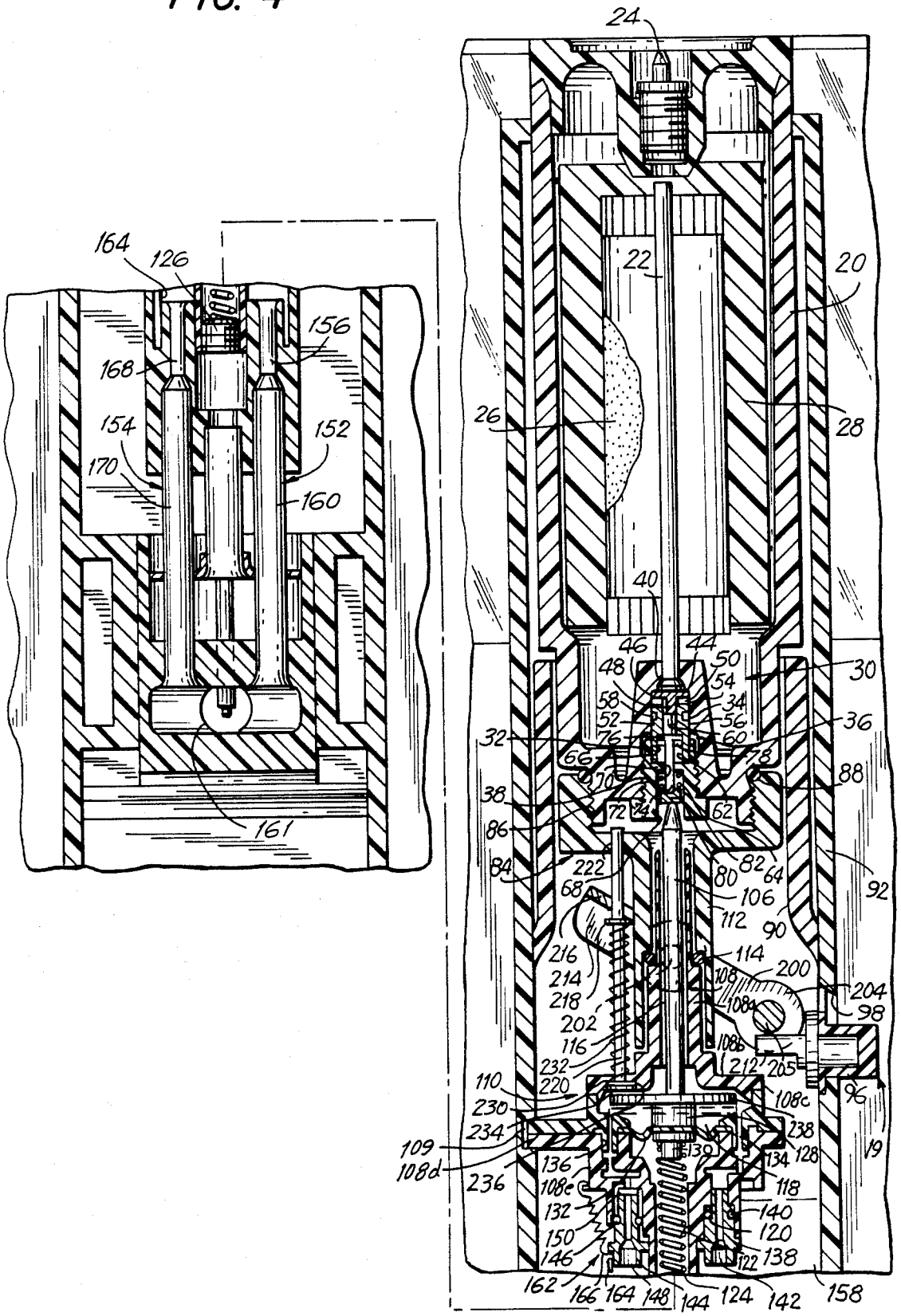
FIG. 4 is a cross-sectional view of the portable hair roller heating device of FIG. 1, taken along line 4—4 thereof.

As discussed, hair roller heating device 10 is gas fueled, the gas being carried in fuel cartridge 20 and transported to the delivery end by a sintered plastic wick 22. Cartridge 20 may be refillable through a fill valve 24, or replaceable, as desired. As shown in FIG. 4, cartridge 20 includes a charcoal filter material 26 and a foam lining 28, as is conventional.

In addition, cartridge 20 includes a fuel delivery valve 30 at the end opposite fill valve 24. Specifically, fuel delivery valve 30 is assembled in a molded well 32 in the end of cartridge 20 which attaches to hair roller heating device 10. Molded well 32 includes a smooth first section 34 having a first diameter, and a second section 36 having a second, larger diameter which is threaded as at 38.

Fuel delivery valve 30 includes an aluminum wick holder 40 press fit into the inner end of first section 34 of molded well 32. One end of sintered plastic wick 22 is pressed into wick holder 40 and the opposite end of wick 22 extends to the opposite end of cartridge 20, which because of the vertical positioning of cartridge 20, is positioned at the top of cartridge 20, as shown in FIG. 4. A cylindrical brass part 44 is positioned within well 32. Cylindrical brass part 44 includes a first section 46 adjacent wick holder 40 and having a diameter substantially equal to that of smooth first section 34, and a second shaft section 48 of a smaller diameter. A tube of compressible foam 50, which forms an adjustable flow restrictor, has a central opening and is located on second shaft section 48 of brass part 44, where the latter centers foam tube 50 within well 32. As will be appreciated from the discussion hereinafter, the degree of compression of foam tube 50 changes the flow rate of gas therethrough.

After the above has been assembled in well 32, the portion of fuel delivery valve 30 which compresses foam tube 50 is assembled in well 32. Specifically, a tubular brass spacer 52 having an outer diameter substantially equal to that of smooth first section 34 of well 32 is slidably fit therein. Spacer 52 includes an end face 54 which abuts against foam tube 50 to compress the same when a force is applied thereto. A circular groove 56 is formed in the outer surface of spacer 52 in which an O-ring 58 is inserted for preventing any leakage between the inner wall of well 32 and the outer surface of spacer 52. Spacer 52 includes a central bore 60 of substantially equal diameter to second shaft section 48 of cylindrical brass part 44 and which slidably fits thereover. Central bore 60 has an enlarged diameter, as at 62, at the opposite end thereof.

A cylindrical molded plastic upper valve housing 64 is provided with external threads which screw threadedly mate with threads 38 of second section 36 of well 32 for securing housing 64 therein. Housing 64 includes a first central, cylindrical recess 66 at one end which surrounds the outer surface of spacer 52, and a second central, cylindrical recess 68 at the opposite end, recesses 66 and 68 being separated by a wall 70 having a central aperture 72 therein. A stem 74 is slidably fit within aperture 72 and includes an enlarged head 76 on the end facing into cartridge 20, enlarged head 76 having an outer diameter substantially equal to that of enlarged diameter section 62 of central bore 60, but slidably fit therein. Thus, stem 74 is shaped like a tiny common nail, but with no sharp point. An annular rubber seal 78 is fit on stem 74 in abutment with enlarged head 76. The opposite end of stem 74 which extends to the opposite side of wall 70, is press fit into a plastic cap 80 which is slidably positioned within second cylindrical recess 68, plastic cap 80 being outwardly biased by a coil spring 82 also positioned within second cylindrical recess 68.

In operation, when no inwardly directed force is applied to plastic cap 80, coil spring 82 outwardly biases plastic cap 80, thereby causing annular rubber seal 78 to be biased downwardly in FIG. 4 in contact with and sandwiched between enlarged head 76 and wall 70, to maintain annular rubber seal 78 in compression so as to prevent the flow of any gas from cartridge 18. As will be explained hereinafter, this occurs when cartridge 18 is not activated by switch button 19.

When an inwardly directed force is applied to plastic cap 80, the latter moves upwardly in FIG. 4 to the position shown, compressing coil spring 82 and moving stem 74, enlarged head 76 and annular rubber seal 78 out of the sealing position, whereby gas can flow out of cartridge 20. The amount of gas flow will depend on the extent that foam tube 50 is compressed. It will be noted that, since housing 64 is screw threadedly received within wall 32, the amount of upward travel of stem 74 and enlarged head 76, and therefore the extent of compression of foam tube 50, will vary depending on the distance that housing 64 is screw threaded into wall 32. Housing 64 is shown in FIG. 4 screw threaded to its maximum extent. The gas flow rate is preferably set at the factory and is not consumer adjustable.

As shown, cartridge 20 is secured to an adapter 84 of hair roller heating device 10 through screw threads 86 and is sealed with an O-ring 88 in a conventional manner. Adaptor 84 is fixed to an extension 90 of the side wall of a housing 92 in which cartridge 20 and the gas supply assembly associated therewith is fit, housing 87 being secured to the rear of housing 11. In this manner, cartridge 20 is immovable within housing 92.

Switch button 19 includes a switch knob pin 96 which extends through an elongated slot 98 in housing 92. Switch button 19 may also be normally biased upwardly in FIG. 4 by a spring (not shown). As will be described hereinafter, when switch button 19 is moved downwardly, gas flow is started, and when switch button 19 is moved upwardly, this stops the flow of gas.

Figure 2:
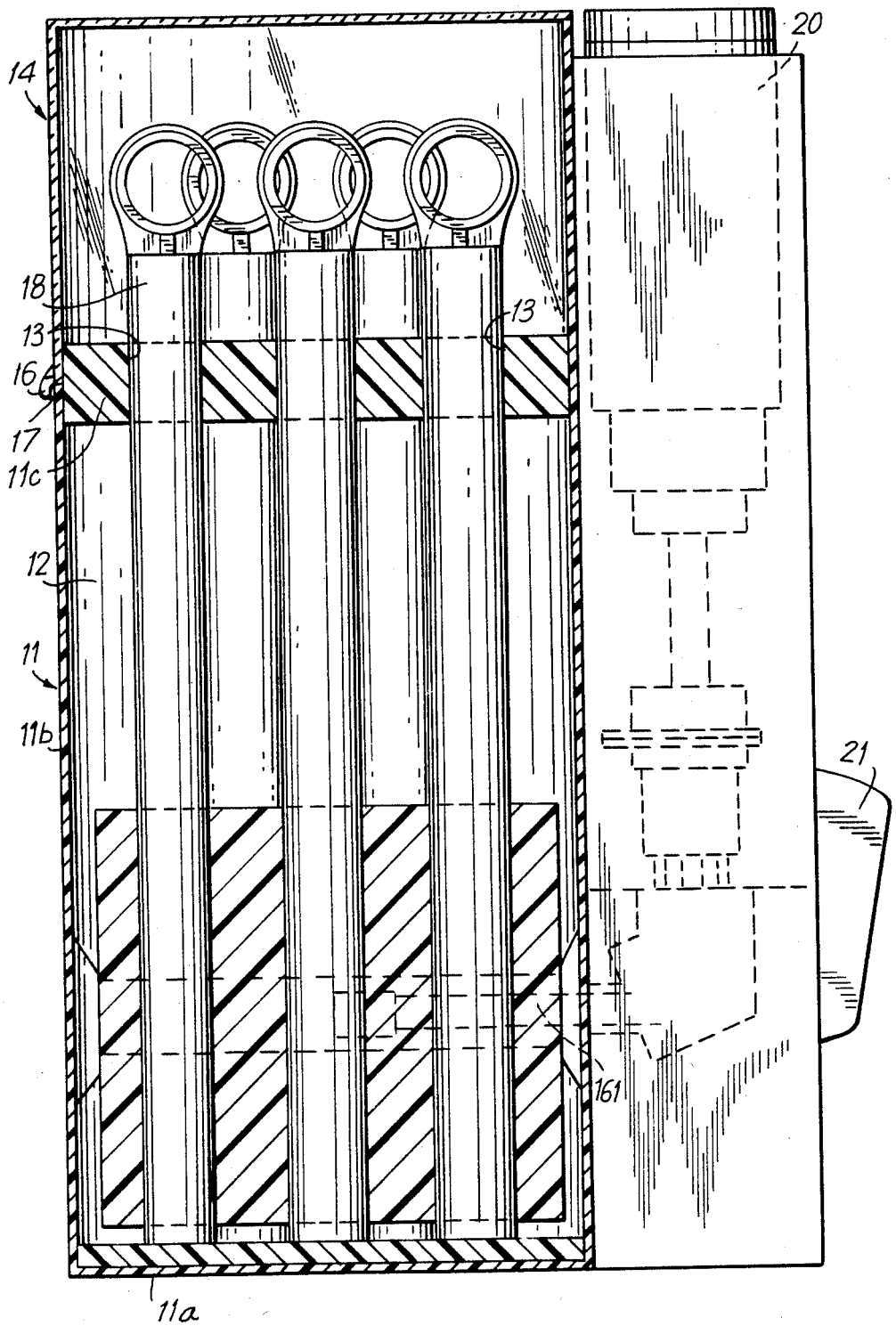
FIG. 2 is a cross-sectional view of the portable hair roller heating device of FIG. 1, taken along line 2—2 thereof.

Specifically, when switch button 19 is moved downwardly in FIG. 4, as shown, this permits a plunger 106 to hit against plastic cap 80 to move stem 74 and annular rubber seal 78 out of the aforementioned sealing arrangement to permit the flow of gas. When switch 19 is moved upwardly in FIG. 4, plunger 106 no longer applies a depressing force to plastic cap 80. As a result, coil spring 82 biases plastic cap 80, stem 74, enlarged head 76 and annular rubber seal 78 downwardly in FIG. 2 in the aforementioned sealing arrangement to prevent any flow of gas from cartridge 20.

Plunger 106 is slidably received within a regulator housing 108 of a regulator assembly 110 which, in turn, is slidably received within a central cylindrical section 112 of adapter 84. An O-ring 114 provides a sliding seal between a first section 108*a* of regulator housing 108 and cylindrical section 112. Thus, gas can only flow from cartridge 20 through a cap 116 provided between plunger 106 and first section 108*a* of regulator housing 108.

The purpose of regulator assembly 110 is to provide vaporized fuel at constant pressure independent of ambient temperature, fuel consumption rate, orientation, brand of fuel and fuel level. Thus, a known amount of heat is produced at all times, corresponding to fuel consumption. Therefore, temperature regulation is not necessary to maintain barrel temperature during use and because of this, hair roller heating device 10 according to the present invention is easier to assemble and adjust than previously known devices.

As shown in FIG. 4, first section 108*a* of regulator housing 108 includes a radially directed section 108*b* at the end thereof which extends from cylindrical section 112. Radially directed section 108*b* is connected to a second section 108*c* of regulator housing 108 which, in turn, is connected to a third section 108*d* thereof. The latter section 108*d* is fixed within an annular groove 109 in housing 92 and is connected to still a fourth section 108*e* of regulator housing 108. Of course, all of the sections of regulator housing 108 can be constructed in a one piece molding operation. Radially directed section 108*b* and second, third and fourth sections 108*a*, 108*d* and 108*e*, respectively, define a gas flow chamber 118 through which gas flows from gap 116 between first sectio 108*a* of regulator housing 108 and plunger 106.

Regulator assembly 110 further includes an inner assembly 120 within chamber 118 and which defines a central bore 122 which houses a coil spring 124. An adjusting screw 126 is screw threadedly received within central bore 122, against which one end of coil spring 124 abuts. A plunger stopper 128 is secured to one end of plunger 106, and includes a central boss 130 at the opposite end thereof. The opposite end of coil spring 124 surrounds and is centered by boss 130 and abuts against the respective end face of plunger stopper 128. Thus, coil spring 124 pushes on plunger 106, biasing it in the direction of cartridge 20 into abutment with plastic cap 80 of fuel delivery valve 30 when cartridge 20 is secured within housing 92. Butane gas therefore flows from cartridge 20, through gap 116 to chamber 118.

As discussed above, cartridge 20 is always stationary with respect to housing 92, and plunger 106 is caused to move with respect to stationary cartridge 20. As shown, a lever 200 is pivotally mounted substantially midway along the length thereof by pivot pins 202 within the housing, in the manner taught in copending U.S. patent application Ser. No. 06/781,262, the entire disclosure of which is incorporated herein by reference. It is preferable that the axis of pivot pins 202 be transverse to and intersect the axis of plunger 106, as shown in FIG. 4, although the actual pivot pins 202 do not intersect plunger 106. Lever 200 has a bifurcated configuration, whereby pivot pins 202 pivotally mount each leg thereof. The upper end 204 of lever 200 includes a roller 205 rotatably secured thereto between legs 200*a* and 200*b*, with roller 205, and thereby lever 200, being pivotally biased about pivot pin 202 by switch button 19. Switch button 19 includes switch knob pin 96 which extends through and is slidably received in elongated slot 98 in housing 92. Switch knob pin 96 includes a reduced dimension section 212 at the lower end thereof which abuts against roller 205, such that when switch button 19 is moved upwardly in FIG. 4, reduced dimension section 212 will rotate lever 200 counter-clockwise about pivot pins 202.

The opposite, lower end 214 of lever 200 includes a transverse connecting section 216 which secures the legs of lever 200 together and which normally abuts against a ring 218 secured about a shaft 220. In this regard, connecting section 216 includes a cut-out section (not shown) for slidably receiving shaft 220. Shaft 220 is axially movable and is supported at one end within an aperture 222 of adapter 84, the latter being secured to housing 92, and at the other end, through an aperture 230 extending through radially directed section 108*b* of regulator housing 108. A coil spring 232 surrounds shaft 220, and is positioned between radially directed section 108*b* of regulator housing 108 and ring 218 for normally biasing shaft 220 upwardly in FIG. 4.

As shown in FIG. 4, a ring 234 is secured around the extreme end of shaft 220 as it extends through aperture 230, and a gasket 236 is secured around shaft 220 and to the inner surface of ring 234. Thus, when spring 232 biases shaft 220 upwardly in FIG. 4, to the position shown, gasket 236 provides a seal against leakage of gas to the outside through aperture 230. Further, a ring 238 or similar abutment member is secured to plunger 106 immediately in front of plunger stopper 128.

In operation, when switch button 19 is moved downwardly in FIG. 4, shaft 220 is no longer biased by lever 200. Accordingly, coil spring 232 biases shaft 220 upwardly in FIG. 4, to the position shown. As a result, ring 218 secured to shaft 220 abuts against flange 216 and pivots lever 200 clockwise about pivot pin 202 to the position shown, so that roller 205 is in abutting relation with switch button 19. In such position, coil spring 124 biases plunger stopper 128 and thereby plunger 106 upwardly in FIG. 4 against plastic cap 80 to start the flow of gas.

When switch button 19 is moved upwardly in FIG. 4, reduced dimension section 212 thereof abuts against roller 205 and pivots lever 200 counter-clockwise about pivot pins 202. As a result, flange 216 at the lower end 214 of lever 200 abuts against ring 218 and biases shaft 220 downwardly in FIG. 4, against the force of coil spring 232. Thus, ring 234 abuts against and biases ring 238 downwardly in FIG. 4. Accordingly, plunger 106 no longer pushes in plastic cap 80, so that the flow of gas is stopped. It will be appreciated that in the OFF position, suitable means is provided for locking switch button 19 in the OFF position. For example, this may take the form of a transverse notch extending from slot 98 in which switch button 19 can be positioned, so that coil spring 232 does not move switch button 19 to the ON position when the force used to move it to the OFF position has been released.

As also shown in FIG. 4, a rubber diaphragm 132 is secured to inner assembly 120 and to plunger stopper 128. When the pressure of the fuel entering chamber 118 becomes too great, rubber diagraphm 132 is biased downwardly in FIG. 4 against the force of coil spring 124, to move plunger 106 away from fuel delivery valve 30, whereby coil spring 82 of fuel delivery valve 30 causes it to close, halting the flow of gas. Once the gas pressure is reduced by burning the fuel, coil spring 124 moves rubber diaphragm 132 and plunger 106 upwardly in FIG. 4, to the position shown, to once again open fuel delivery valve 30. This cycle continues and maintains a constant pressure on the outlet side of regulator assembly 110 as long as switch button 19 remains in the ON position. It will be appreciated that, turning adjusting screw 126, alters the compression of coil spring 124, thus adjusting the gas flow pressure.

Regulator housing 108 and inner assembly 120 define two narrow channels 134 and 136 therebetween through which gas from chamber 118 escapes, each channel leading toward a respective orifice-venturi-burner assembly. Specifically, channel 134 leads to a valve stem 138 positioned within a recess defined between fourth section 108*e* of regulator housing 108 and inner assembly 120. An O-ring 140 surrounds valve stem 138 at mid-length to provide a gas tight seal. Valve stem 138 includes a central bore which defines a gas flow orifice 142 in fluid communication with channel 134.

In like manner, a valve stem 144 is positioned within a recess defined between fourth sectio 108*e* of regulator housing 108 and inner assembly 120, diametrically opposite valve stem 138. An O-ring 146 surrounds valve stem 144 at mid-length to provide a gas tight seal. In addition, valve stem 144 includes a central bore which defines a gas flow orifice 148 in fluid communication with channel 136. An annular, resilient valve pad 150 is positioned at the end of valve stem 144 between channel 136 and orifice 148. As will be appreciated from the description which follows, O-ring 146 acts as the fulcrum of a lever, whereby valve stem 144 can rotate or rock thereabout to make or break a seal between channel 136 and orifice 148, by means of valve pad 150. Thus, when valve stem 144 is axially in line with channel 136, there is no gas seal, and butane vapors flow from channel 136, through the central aperture of valve pad 150 to orifice 148. On the other hand, when valve stem 144 is tilted or rotated about O-ring 146, the central aperture of valve pad 150 is out of line with channel 136 and orifice 148, so that a seal is provided which blocks the passage of gas to orifice 148.

The butane vapor from orifice 142 leads to a main burner 152, while the butane vapor from orifice 148 leads to a fast heat up burner 154. The burners differ in purpose, and each will be discussed beginning with main burner 152.

The purpose of main burner 152 is to provide enough heat to maintain chamber 12 at a desired temperature during use. After the butane vapor leaves orifice 142, it passes through a venturi tube 156, where air supplied from an annular chamber 158 is entrained to make a combustible mixture. Orifice 142 is of sufficient size to increase the velocity of the butane vapor so that the correct amount of air for efficient burning will be entrained in venturi tube 156. The size of the orifice determines how much fuel enters each burner at a given pressure. The amount of fuel determines the heat up rate and equilibrium temperature attained. The air-butane vapor mixture then travels down a stainless steel tube 160 to a junction tube 161 where ignition and combustion occur. There, the fuel is ignited by an electric spark when the ignition push button 21 is pressed, and burns as long as ON/OFF switch button 19 is ON.

The purpose of the fast heat up burner 154 is to reduce the time required to heat chamber 12 from ambient to working temperature. It differs from main burner 152 by virtue of a thermostatically controlled valve assembly 162 which allows fuel to flow until chamber 12 reaches a predetermined temperature at which point a bimetallic element 164 thereof, secured to housing 92 and to valve stem 144, deflects, and a spring 166 secured to fourth section 108*e* of regulator housing 108 and valve stem 144, pivots valve stem 144 about O-ring 146, whereby valve pad 150 provides a seal to prevent fuel flow through orifice 148 of valve stem 144. When chamber 12 is not at the predetermined temperature, bimetallic element 164 applies a force to valve stem 144, normal to its axis and against the force of spring 166, to maintain orifice 148 of valve stem 144 in its open condition, whereby butane vapor enters orifice 148 and then travels through a venturi tube 168 where it is entrained with air from annular chamber 158. As with orifice 142, orifice 148 is of sufficient size to increase the velocity of the butane vapor so that the correct amount of air for efficient burning will be entrained in venturi tube 168. The air-fuel mixture from venturi tube 168 travels down a stainless steel tube 170 to junction tube 161 at the opposite end thereof where it mixes with the air-fuel mixture from tube 160 and where ignition and combustion occur. The heat produced by fast heat up burner 154 approximately doubles the heat output of hair roller heating device 10. Of course, with orifice 148 closed by thermostatically controlled valve assembly 162, there is no combustion and therefore no heat.

Therefore, the burner system consists of two parallel paths, each with the same capacity, but one being controlled by regulator assembly 110 and bimetallic element 164 and the other being controlled by regulator assembly 110 alone.

Thus, with the present invention, there is no need to heat chamber with any electric means, and the electric cord, metal tubes and electric heating blankets are eliminated.

Figure 3:
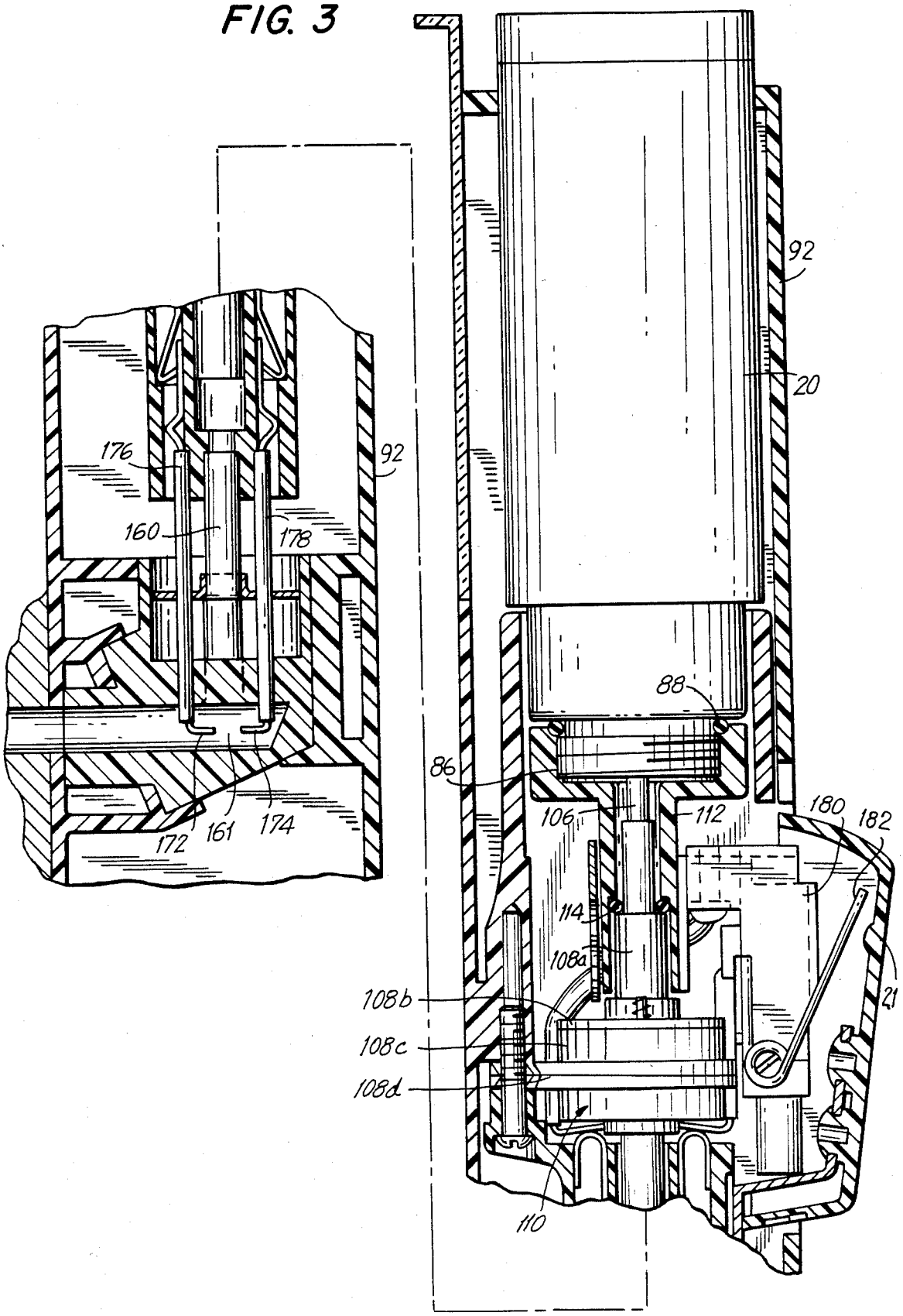
FIG. 3 is a cross-sectional view of the portable hair roller heating device of FIG. 1, taken along line 3—3 thereof.

Ignition is accomplished by an electric spark traveling from electrodes 172 and 174 to the ends of stainless steel tubes 160 and 170, where combustion takes place, as shown in FIG. 3. Specifically, electrodes 172 and 174 are encased partially in ceramic tubes 176 and 178, respectively, with the ends thereof being exposed at the ends of stainless steel tubes 160 and 170, as shown. The opposite ends of electrodes 172 and 174 extend into electrical contact with a piezoelectric crystal 180 which generates a spark when struck by a spring loaded hammer 182 when ignition push button 21 is pressed. Ignition push button 21 is mounted between cartridge 20 and regulator assembly 110, measured in the lengthwise direction of hair roller heating device 10, so that ignition push button 21 is next to ON/OFF switch button 19.

Thus, to operate hair roller heating device 10, switch button 17 is bieased downwardly in FIG. 4, to turn ON the flow of butane gas. Then, ignition push button 21 is pressed once or twice to ignite the gas-air mixture at the end of stainless steel tubes 160 and 170. Initially, both burners 152 and 154 are activated to quickly bring chamber 12 up to the predetermined temperature. Once this temperature is attained, bimetallic element 164 deflects and spring 166 pivots valve stem 144 about O-ring 146 to prevent the flow of gas therethrough, and thereby shut off fast heat up burner 154. The predetermined temperature is then maintained by regulator assembly 110 which is initially set for the particular desired temperature. As the gas flow increases too much, whereby the temperature also rises, the gas flow is cut off, until the pressure in chamber 118 decreases (corresponding to the desired temperature).

Further, the combustion area of hair roller heating device 10 is preferably surrounded by an expanded aluminum or wire woven screen (not shown). The purpose of the screen is to even out the temperature of the exhaust gases, all of which must pass through it. Additionally, exhaust ports (not shown) in chamber 12, which are conventional, have screens (not shown) of the same expanded aluminum, yielding a double flame arresting barrier against hot exhaust gases (even during ignition). Thus, hair roller heating device 10 can be started and run in an explosive atmosphere of common household solvents with no danger of hair roller heating device 10 starting a fire or explosion.

It will also be appreciated that the regulator assembly has independent value and can be used without the two burner system. In like manner, the two burner system can be used without the regulator assembly.

Although the present invention has been described with respect to a hair roller heating device, it will be appreciated that it can be used as numerous other products.

Having described a specific preferred embodiment of the invention with reference to the accompanying drawings, it is to be appreciated that the present invention is not limited to that precise embodiment and that various changes and modifications can be effected therein by one of ordinary skill in the art without departing from the spirit and scope of the invention as defined by the appended claims.

What is claimed is:

1. A portable heating appliance comprising:

an enclosed heating chamber defined by a top wall, side wall and bottom wall, at least one of said walls having a plurality of apertures through which elongated objects to be heated can be inserted;

burner means positioned adjacent said chamber for heating said objects inserted through said apertures, said burner means having a first burner tube with a free end and a heating tube fluidly connected with said first burner tube and extending into said chamber;

a fuel container for supplying fuel to said burner means through said first burner tube, said fuel container including fuel delivery valve means for controlling the flow of fuel from said fuel container, said fuel delivery valve means including control means for preventing the flow of fuel when in a first position and for permitting the flow of fuel when in a second, different position, and first biasing means for biasing said control means to said first position;

actuator means for actuating said fuel delivery valve means in response to user actuation to start the flow of fuel from said fuel container, said actuator means including plunger means which pushes in said control means from said first position to said second position against the force of said biasing means to open said fuel delivery valve means so that the latter permits the flow of fuel to said burner means;

regulator means for maintaining a substantially constant flow rate of fuel to said burner means; and ignition means for igniting said fuel in said heating tube so as to heat said chamber.

2. A portable heating appliance according to claim 1; wherein said apertures are provided in said top wall.

3. A portable heating appliance according to claim 2; further including a cover removably connected on said top wall so as to cover portions of said objects extending through said top wall.

4. A portable heating appliance according to claim 3; wherein said cover is hingedly connected on said top wall.

5. A portable heating appliance according to claim 1; wherein said objects to be heated are flexible hair rollers.

6. A portable heating appliance comprising:

an enclosed heating chamber defined by a top wall, side wall and bottom wall, at least one of said walls having a plurality of apertures through which elongated objects to be heated can be inserted;

burner means positioned adjacent said chamber for heating said objects inserted through said apertures, said burner means having a first burner tube with a free end, a heating tube fluidly connected with said first burner tube and extending into said chamber, and a second burner tube having a free end, said first and second burner tubes being joined at free ends thereof to said heating tube in fluid communication therewith; and fuel supply means for supplying fuel to said burner means through said first burner tube; and ignition means for igniting said fuel in said heating tube so as to heat said chamber.

7. A portable heating appliance according to claim 6; further including means for terminating the flow of fuel to said second burner tube when a predetermined temperature in said chamber is reached.

8. A portable heating appliance according to claim 7; further comprising conduit means for carrying said fuel from said fuel supply means to said first and second burner tubes; and said means for terminating includes means for preventing the flow of fuel through said conduit means to said second burner tube.

9. A portable heating appliance according to claim 8; wherein said conduit means includes first valve stem means for carrying said fuel from said fuel supply means to said first burner tube and second valve stem means for carrying said fuel from said fuel supply means to said second burner tube, said second valve stem means being movable between a first position to permit the flow of fuel from said fuel supply means to said second burner tube and a second position to prevent the flow of fuel from said fuel supply means to said second burner tube; and wherein said means for preventing includes first biasing means for moving said second valve stem means to said first position when the temperature in said chamber is less than said predetermined temperature and second biasing means for moving said second valve stem means to said second position when the temperature is at least equal to said predetermined temperature.

10. A portable heating appliance according to claim 9; wherein said second valve stem means includes a fuel flowing orifice; and further including channel means for supplying said fuel from said fuel supply means to said orifice of said second valve stem means, and valve pad means positioned between said channel means and said orifice for permitting the flow of fuel to said orifice when said second valve stem means is in said first position and for preventing the flow of fuel to said orifice when said second valve stem means is in said second position.

11. A portable heating appliance according to claim 9; wherein said first biasing means includes a bimetallic element which biases said second valve stem means to said first position when said temperature is less than said predetermined temperature and which removes said bias when the temperature is at least equal to said predetermined temperature; and said second biasing means includes spring means which biases said second valve stem means to said second position when the temperature is at least equal to said predetermined temperature and said bimetallic element removes said bias therefrom.

12. A portable heating appliance according to claim 9; wherein said fuel supply means includes fuel delivery valve means for controlling the flow of fuel from said fuel supply means; and further comprising actuator means for actuating said fuel delivery valve means in response to user actuation to start the flow of fuel from said fuel supply means, and regulator means for controlling said actuator means so as to maintain a substantially constant flow rate of fuel to said first and second burner means.

13. A portable heating appliance according to claim 12; wherein said actuator means includes a plunger and biasing means for applying a force to said plunger to bias the latter into engagement with said fuel delivery valve means to control the latter to permit the flow of fuel from said fuel supply means.

14. A portable heating appliance according to claim 13; wherein said regulator means includes diaphragm means for applying a force to said plunger against the force from said biasing means when the pressure of said fuel from said fuel supply means is greater than a second predetermined pressure to control said fuel delivery valve means to prevent the flow of fuel from said fuel supply means.

15. A portable heating appliance according to claim 13; wherein said actuator means includes means for adjusting the force applied by said biasing means to said plunger.

16. A portable heating appliance according to claim 15; wherein said biasing means includes a coil spring applying a force against said plunger, and said means for adjusting includes an adjusting screw against which one end of said coil spring abuts and which is adjustable to vary the force applied by said coil spring to said plunger.

17. A portable heating appliance according to claim 13; wherein said fuel delivery valve means includes valve housing means in one end of said fuel supply means, said valve housing means including an aperture through which said fuel escapes from said fuel supply means, valve pad means movable to a first position for preventing the flow of fuel through said aperture and to a second position for permitting the flow of fuel through said aperture, and stem means for moving said valve pad means between said first and second positions in response to movement of said plunger.

18. A portable heating appliance according to claim 17; wherein said stem means extends through said aperture, and a cap is secured to said stem means extending through said aperture, said plunger applying a force to said cap to control said stem means to move said valve pad means to said second position to permit the flow of fuel through said aperture; and said fuel delivery valve means further including biasing means for applying a force to said cap when said plunger does not apply said force to said cap so as to control said stem means to move said valve pad means to said first position to prevent the flow of fuel through said aperture.

19. A portable heating appliance according to claim 18; wherein said fuel delivery valve means further includes restrictor means for varying the amount of fuel supplied by said fuel supply means in response to the force applied by said plunger through said stem means.

20. A portable heating appliance according to claim 19; wherein said restrictor means includes a compressible foam tube which is compressed by said stem means to an extent depending on the force applied thereto by said plunger.

21. A portable heating appliance according to claim 1; wherein said portable heating appliance is a hair roller heating device.

22. A portable heating appliance according to claim 1; wherein said actuator means includes second biasing means for applying a force to said plunger to bias the latter into engagement with said fuel delivery valve means to control the latter to permit the flow of fuel from said fuel container.

23. A portable heating appliance according to claim 22; wherein said regulator means includes diaphragm means for applying a force to said plunger against the force from said second biasing means when the pressure of said fuel from said fuel container is greater than a predetermined pressure to control said fuel delivery valve means to prevent the flow of fuel from said fuel container.

24. A portable heating appliance according to claim 22; wherein said actuator means includes means for adjusting the force applied by said biasing means to said plunger.

25. A portable heating appliance comprising:

an enlcosed heating chamber defined by a top wall, side wall and bottom wall, at least one of said walls having a plurality of apertures through which elongated objects to be heated can be inserted;

burner means positioned adjacent said chamber for heating said objects inserted through said apertures, said burner means having a first burner tube with a free end and a heating tube fluidly connected with said first burner tube and extending into said chamber;

fuel supply means for supplying fuel to said burner means through said first buffer tube, said fuel supply means includes fuel delivery valve means for controlling the flow of fuel from said fuel supply means;

actuator means for actuating said fuel delivery valve means in response to user actuation to start the flow of fuel from said fuel supply means, said actuator means including a plunger, biasing means for applying a force to said plunger to bias the latter into engagement with said fuel delivery valve means to control the latter to permit the flow of fuel from said fuel supply means, and means for adjusting the force applied by said biasing means to said plunger, wherein said biasing means includes a coil spring applying a force against said plunger, and said means for adjusting includes an adjusting screw against which one end of said coil spring abuts and which is adjustable to vary the force applied by said coil spring to said plunger;

regulator means for controlling said actuator means to maintain a substantially constant flow rate of fuel to said burner means;

ignition means for igniting said fuel in said heating tube so as to heat said chamber.

26. A portable heating appliance according to claim 22; wherein said fuel delivery valve means includes valve housing means in one end of said fuel supply means, said valve housing means including an aperture through which said fuel escapes from said fuel supply means, valve pad means movable to a first position for preventing the flow of fuel through said aperture and to a second position for permitting the flow of fuel through said aperture, and stem means for moving said valve pad means between said first and second positions in response to movement of said plunger.

27. A portable heating appliance comprising:

an enclosed heating chamber defined by a top wall, side wall and bottom wall, at least one of said walls having a plurality of apertures through which elongated objects to be heated can be inserted;

burner means positioned adjacent said chamber for heating said objects inserted through said apertures, said burner means having a first burner tube with a free end and a heating tube fluidly connected with said first burner tube and extending into said chamber;

fuel supply means for supplying fuel to said burner means through said first burner tube, said fuel supply means includes fuel delivery valve means for controlling the flow of fuel from said fuel supply means;

actuator means for actuating said fuel delivery valve means in response to user actuation to start the flow of fuel from said fuel supply means, said actuator means including a plunger and biasing means for applying a force to said plunger to bias the latter into engagement with said fuel delivery valve means to control the latter to permit the flow of fuel from said fuel supply means;

regulator means for controlling said actuator means to maintain a substantially constant flow rate of fuel to said burner means; and ignition means for igniting said fuel in said heating tube so as to heat said chamber;

wherein said fuel delivery valve means includes valve housing means in one end of said fuel supply means, said valve housing means including an aperture through which said fuel escapes from said fuel supply means, valve pad means movable to a first position for preventing the flow of fuel through said aperture and to a second position for permitting the flow of fuel through said aperture, and stem means for moving said valve pad means between said first and second positions in response to movement of said plunger;

wherein said stem means extends through said aperture, and a cap is secured to said stem means extending through said aperture, said plunger applying a force to said cap to control said stem means to move said valve pad means to said second position to permit the flow of fuel through said aperture; and said fuel delivery valve means further includes biasing means for applying a force to said cap when said plunger does not apply said force to said cap so as to control said stem means to move said valve pad means to said first position to prevent the flow of fuel through said aperture.

28. A portable heating appliance according to claim 27; wherein said fuel delivery valve means further includes restrictor means for varying the amount of fuel supplied by said fuel supply means in response to the force applied by said plunger through said stem means.

29. A portable heating appliance according to claim 28; wherein said restrictor means includes a compressible foam tube which is compressed by said stem means to an extent depending on the force applied thereto by said plunger.

* * * * *